US010815749B2

(12) United States Patent
Schmidt et al.

(10) Patent No.: US 10,815,749 B2
(45) Date of Patent: Oct. 27, 2020

(54) LOOSELY ASSEMBLED WELLBORE ISOLATION ASSEMBLY

(71) Applicant: HALLIBURTON ENERGY SERVICES, INC., Houston, TX (US)

(72) Inventors: Daniel Lee Schmidt, Dallas, TX (US); Tyler Joseph Norman, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 75 days.

(21) Appl. No.: 16/081,183

(22) PCT Filed: May 12, 2016

(86) PCT No.: PCT/US2016/032086
§ 371 (c)(1),
(2) Date: Aug. 30, 2018

(87) PCT Pub. No.: WO2017/196341
PCT Pub. Date: Nov. 16, 2017

(65) Prior Publication Data

US 2019/0063177 A1 Feb. 28, 2019

(51) Int. Cl.
*E21B 33/128* (2006.01)
*E21B 23/06* (2006.01)
(Continued)

(52) U.S. Cl.
CPC ..... *E21B 33/128* (2013.01); *E21B 23/06* (2013.01); *E21B 33/1208* (2013.01); *E21B 33/134* (2013.01)

(58) Field of Classification Search
CPC .... E21B 33/128; E21B 23/06; E21B 33/1208; E21B 33/134
See application file for complete search history.

(56) References Cited

U.S. PATENT DOCUMENTS 5,101,897 A 4/1992 Leismer et al.
6,167,963 B1 1/2001 McMahan et al.
(Continued)

FOREIGN PATENT DOCUMENTS

CA 2628164 A1 5/2007
WO 2008062178 A1 5/2008
WO 2015028257 A1 3/2015

OTHER PUBLICATIONS

Halliburton Completion Tools, Fas Drill Frac Plug, Service Tools, H06159, Jul. 2014.
(Continued)

*Primary Examiner* — Nicole Coy
(74) *Attorney, Agent, or Firm* — Polsinelli PC

(57) ABSTRACT

A wellbore isolation assembly including a plurality of discrete components each having an inner bore with a center axis, the plurality of discrete components axially abuttable such that each of the inner bores align to form a common bore, the plurality of discrete components including a fixing element; and a sealing element; wherein the plurality of discrete components are integrable by a setting device receivable through the common bore, and wherein application of a compressive force to the plurality of discrete components urges the fixing element and the sealing element to radially extend, relative to the axis of the common bore.

15 Claims, 10 Drawing Sheets

(51) Int. Cl.
*E21B 33/12* (2006.01)
*E21B 33/134* (2006.01)

(56) References Cited

U.S. PATENT DOCUMENTS

| | | | | |
|---|---|---|---|---|
| 8,579,023 | B1 * | 11/2013 | Nish | E21B 33/128 166/134 |
| 8,899,317 | B2 | 12/2014 | Frazier | |
| 9,683,423 | B2 * | 6/2017 | Xu | E21B 33/1208 |
| 9,976,379 | B2 * | 5/2018 | Schmidt | E21B 23/06 |
| 2010/0263857 | A1 | 10/2010 | Frazier | |
| 2011/0005779 | A1 | 1/2011 | Lembcke | |
| 2011/0067890 | A1 | 3/2011 | Themig | |
| 2013/0186616 | A1 * | 7/2013 | Xu | E21B 33/129 166/212 |
| 2013/0186648 | A1 * | 7/2013 | Xu | E21B 23/01 166/382 |
| 2013/0299192 | A1 * | 11/2013 | Xu | E21B 23/01 166/382 |
| 2014/0190685 | A1 | 7/2014 | Frazier | |
| 2014/0262214 | A1 * | 9/2014 | Mhaskar | E21B 33/1291 166/216 |

OTHER PUBLICATIONS

International Search Report and Written Opinion; PCT Application No. PCT/US2016/032086; dated Feb. 9, 2017.

* cited by examiner

LOOSELY ASSEMBLED WELLBORE ISOLATION ASSEMBLY

CROSS-REFERENCE TO RELATED APPLICATIONS

This application is a national stage entry of PCT/US2016/032086 filed May 12, 2016, said application is expressly incorporated herein in its entirety.

FIELD

The present disclosure relates generally to wellbore isolation operations. In particular, the subject matter herein generally relates to a loosely assembled wellbore isolation assembly.

BACKGROUND

Wellbores are drilled into the earth for a variety of purposes including accessing hydrocarbon bearing formations to extract hydrocarbons for use as fuel, lubricants, chemical production, and other purposes. In order to facilitate processes and operations in the wellbore, it may often be desirable to isolate or seal one or more portions of a wellbore. Zonal isolation within a wellbore may be provided by wellbore isolation devices, such as packers, bridge plugs, and fracturing plugs (i.e., "frac" plugs).

Wellbore isolation devices are set in the wellbore by a setting device. For instance, the wellbore isolation device is run into the wellbore coupled to a setting device, which is in turn coupled with a conveyance. When the wellbore isolation device is positioned at the desired depth in the wellbore, the setting device causes the actuation of the slip and seal assemblies on the wellbore isolation device, thereby setting the wellbore isolation device against the wall of the wellbore.

Typical wellbore isolation devices include an inner mandrel extending throughout the inner borehole of the wellbore isolation device. When engaged, one set of slips prevents the wellbore isolation device from traveling downward, the second set of slips prevents the wellbore isolation device from traveling upward, and the sealing assembly holds the slips in tension so that they will not return to a resting position.

BRIEF DESCRIPTION OF THE DRAWINGS

Implementations of the present technology will now be described, by way of example only, with reference to the attached figures, wherein.

DETAILED DESCRIPTION

Figure 1:
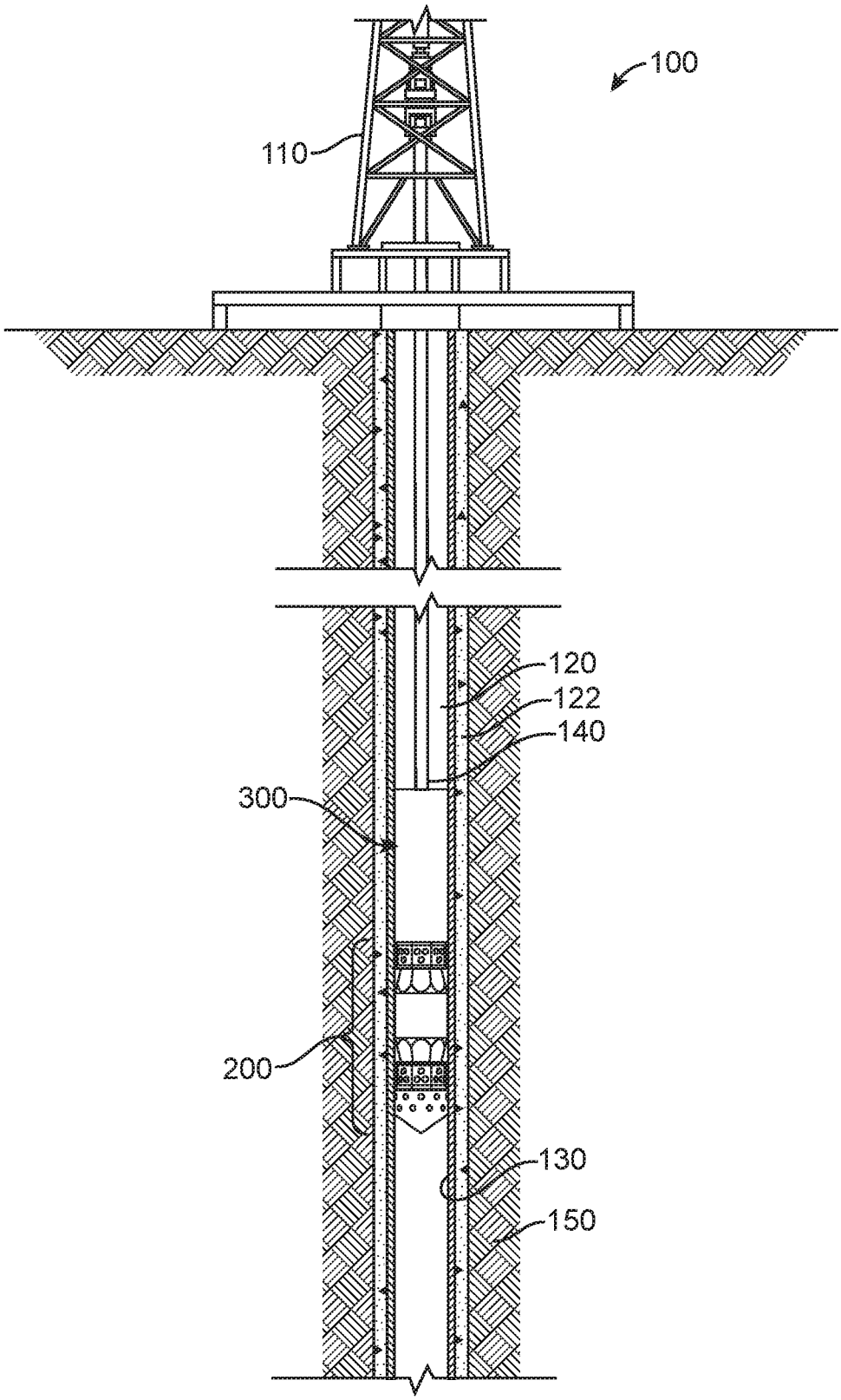
FIG. 1 is a diagram illustrating an exemplary environment for a wellbore isolation assembly according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, reference to up or down is made for purposes of description with "up," "upper," "upward," or "uphole" meaning toward the surface of the wellbore and with "down," "lower," "downward," or "downhole" meaning toward the terminal end of the well, regardless of the wellbore orientation. Correspondingly, the transverse, axial, lateral, longitudinal, radial, etc., orientations shall mean orientations relative to the orientation of the wellbore or tool. The term "axially" means substantially along a direction of the axis of the object. If not specified, the term axially is such that it refers to the longer axis of the object.

Several definitions that apply throughout the above disclosure will now be presented. The term "coupled" is defined as connected, whether directly or indirectly through intervening components, and is not necessarily limited to physical connections. The connection can be such that the objects are permanently connected or releasably connected. The term "integrable" means capable of being combined or connected into a singular unit. The term "outside," "outer," or "external" refers to a region that is beyond the outermost confines of a physical object. The term "inside," "inner," or "internal" refers to a region that is within the outermost confines of a physical object. The terms "comprising," "including" and "having" are used interchangeably in this disclosure. The terms "comprising," "including" and "having" mean to include, but not necessarily be limited to the things so described.

As used herein, the term "degradable" and all of its grammatical variants (e.g., "degrade," "degradation," "degrading," and the like) refer to the dissolution or chemical conversion of solid materials such that reduced-strength solid end-products result by at least one of solubilization, hydrolytic degradation, chemical reactions (including electrochemical and galvanic reactions), or thermal reactions. In complete degradation, no solid end-products result or the end-products are so small as to be irrelevant to the operation of the wellbore. In some instances, the degradation of the material may be sufficient for the mechanical properties of the material to be reduced to a point that the material no longer maintains its integrity and, in essence, falls apart or sloughs off to its surroundings.

As used herein, the term "downhole degradable metal" refers to a metal that is degradable in the wellbore environment. The downhole degradable metals described herein may degrade by galvanic corrosion in the presence of an electrolyte. As used herein, the term "electrolyte" refers to a conducting medium containing ions (e.g., a salt). The term "galvanic corrosion" includes microgalvanic corrosion.

Disclosed herein is a wellbore isolation assembly for use with a setting device for isolating portions of a wellbore. The wellbore isolation assembly is made up of a plurality of discrete components unsupported by an internal mandrel or any central structural tubular body coupling the elements together. Rather than using an internal mandrel, the components are placed directly on a setting device thereby forming an assembled wellbore isolation device. The individual components of the wellbore isolation assembly as disclosed herein includes, for example, a fixing element, a sealing element, at least one wedge component, and an abutment shoe, collectively providing a common bore. The discrete components can be assembled on a setting device that is disposed within the common bore of the wellbore isolation assembly. The components can be placed sequentially on a setting device such that each of the discrete components axially abuts one another. The components can be coupled loosely (as compared to rigid metal internal mandrel coupling the components) for example via shrink-wrap, elastic bands, ropes, pressure fit, adhesively bonded, or any other suitable means to create a temporarily affixed conglomerate of the discrete components. The components can also be packaged in a kit for shipping, the kit can contain the individual discrete components or the assembled wellbore isolation device held together loosely as described above. Accordingly, the components are integrable by a setting device rather than a permanent, internal mandrel.

Subsequent to placement on the setting device, the wellbore isolation assembly can be placed downhole. Upon actuation of the setting device, the setting device causes the fixing element to engage with the at least one wedge component such that protrusions on the outside surface of the fixing element can grip into the casing of the wellbore, fixing the wellbore isolation assembly into place. For example, one or more uni-directional slips within a fixing element can hold the slips in their engaged state, compressing and expanding the sealing element such that the wellbore isolation assembly can maintain a tight seal.

The above described arrangement can significantly decrease the size and cost of a traditional wellbore isolation device by the omission of an internal mandrel throughout the length of the device.

The wellbore isolation assembly disclosed herein may be any of a variety of downhole tools, including, but not limited to, a frac plug, a packer, a bridge plug, a ball plug, a wiper plug, a cement plug, a basepipe plug, and a sand control plug.

An assembled frac plug may include an axial flowbore extending therethrough, and a ball, which can act as a one-way check valve. The ball, when seated on an upper surface of the flowbore, acts to seal off the flowbore and prevent flow downwardly therethrough, but allows flow to continue upward through the flowbore. Frac plugs may include a cage formed at the upper end of the tubular body member to retain the ball.

An assembled packer may include an upper end, a lower end, and an inner surface defining a longitudinal central flow passage. More specifically, a packer element assembly can extend around the tubular body member; and include one or more slips mounted around the body member, above and below the packer assembly. The slips can be guided by mechanical slip bodies.

An assembled bridge plug generally may include one or more slips and a rubber sealing element and is typically used for zonal isolation within a wellbore. More specifically, a bridge plug is a mechanical device installed within a wellbore and used for blocking the flow of fluid from one part of the wellbore to another.

The setting device disclosed herein may be any conventional setting device. Most commonly used setting devices set wellbore isolation devices from the bottom by attaching the setting device to the downhole end of the device and placing an abutment shoulder on top of the device. The abutment shoulder holds the wellbore isolation device in place as the setting device pulls the tubular body, or mandrel, of the device in the uphole direction. Upon actuation, the setting device generates a large amount of force, often in excess of 20,000 pounds, producing significant tension on the tubular body of the wellbore isolation device. The tension in the tubular body of the wellbore isolation device, produced by the setting device, compresses the various components and causes the slips to radially extend against the wall of the wellbore or casing, thereby setting the wellbore isolation device and establishing a zonal isolation seal. Various types of setting devices exist. Setting devices can be activated by hydrostatic or hydraulic pressure. However, some setting devices, such as the Model E-4™ Wireline Pressure Setting Assembly (commercially available from Baker Hughes) and the "Shorty" (commercially available from Halliburton Energy Services, Inc.), are explosive setting devices that are activated by means of a pyrotechnic or black powder charge.

The wellbore isolation assembly can be deployed in an exemplary wellbore system 100 shown, for example, in FIG. 1. A system 100 for wellbore isolation can include a drilling rig 110 extending over and around a wellbore 120. The wellbore 120 is drilled within an earth formation 150 and has a casing 130 lining the wellbore 120, the casing 130 is held into place by cement 122. A wellbore isolation assembly 200 can include a plurality of discrete components. The wellbore isolation assembly 200 can be moved down the wellbore 120 via a conveyance 140 to a desired location. A conveyance can be, for example, tubing-conveyed, coiled tubing, joint tubing, or other tubulars, wireline, slickline, work string, or any other suitable means for conveying tools into a wellbore. Once the wellbore isolation assembly 200 reaches the desired location a setting tool assembly 300 may be actuated to secure the wellbore isolation assembly into place.

It should be noted that while FIG. 1 generally depicts a land-based operation, those skilled in the art would readily recognize that the principles described herein are equally applicable to operations that employ floating or sea-based platforms and rigs, without departing from the scope of the disclosure. Also, even though FIG. 1 depicts a vertical wellbore, the present disclosure is equally well-suited for use in wellbores having other orientations, including horizontal wellbores, slanted wellbores, multilateral wellbores or the like.

Figure 2:
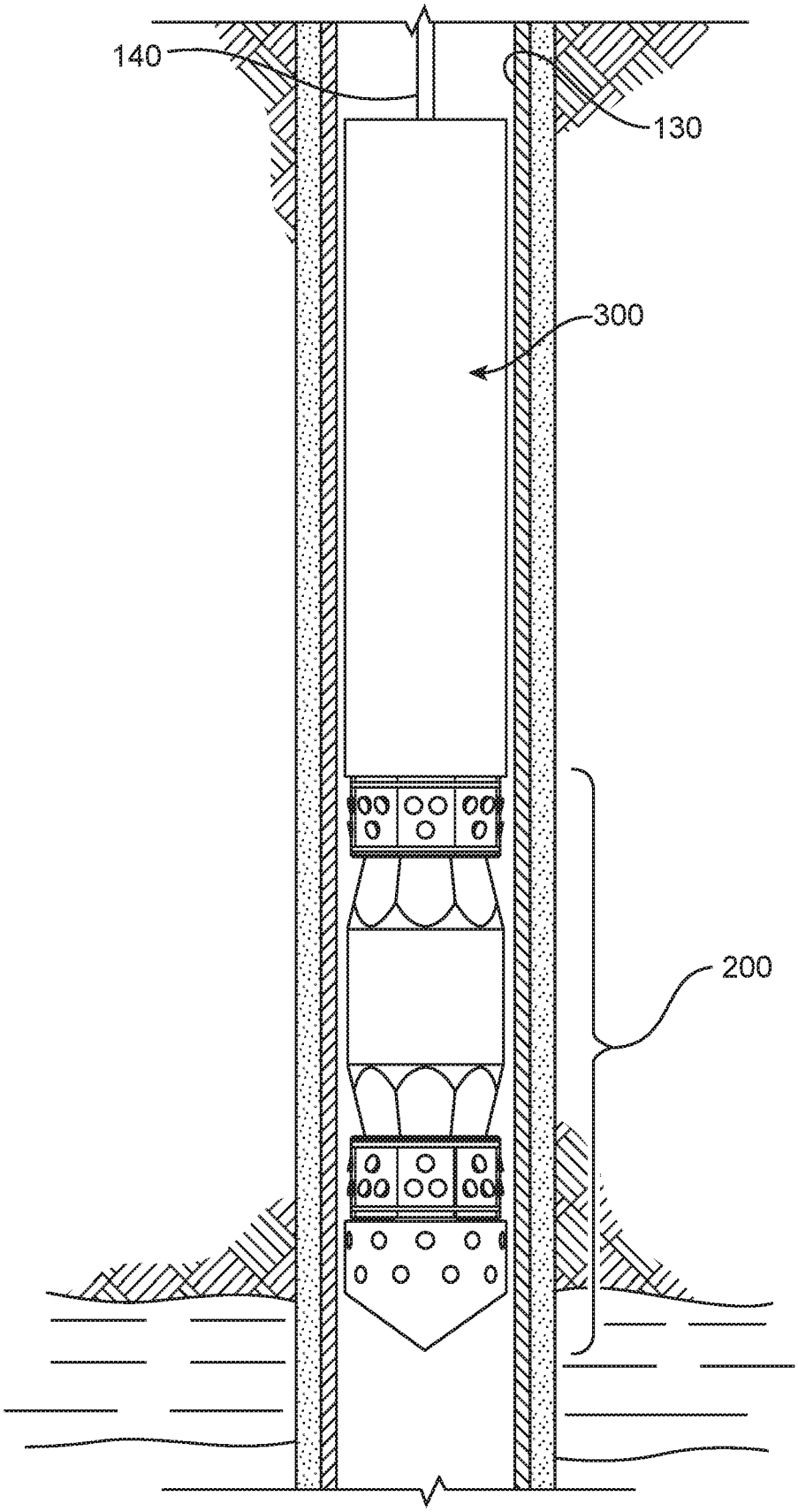
FIG. 2 is a diagram illustrating an exemplary environment for a wellbore isolation assembly in a resting configuration disposed within a wellbore.
Figure 3:
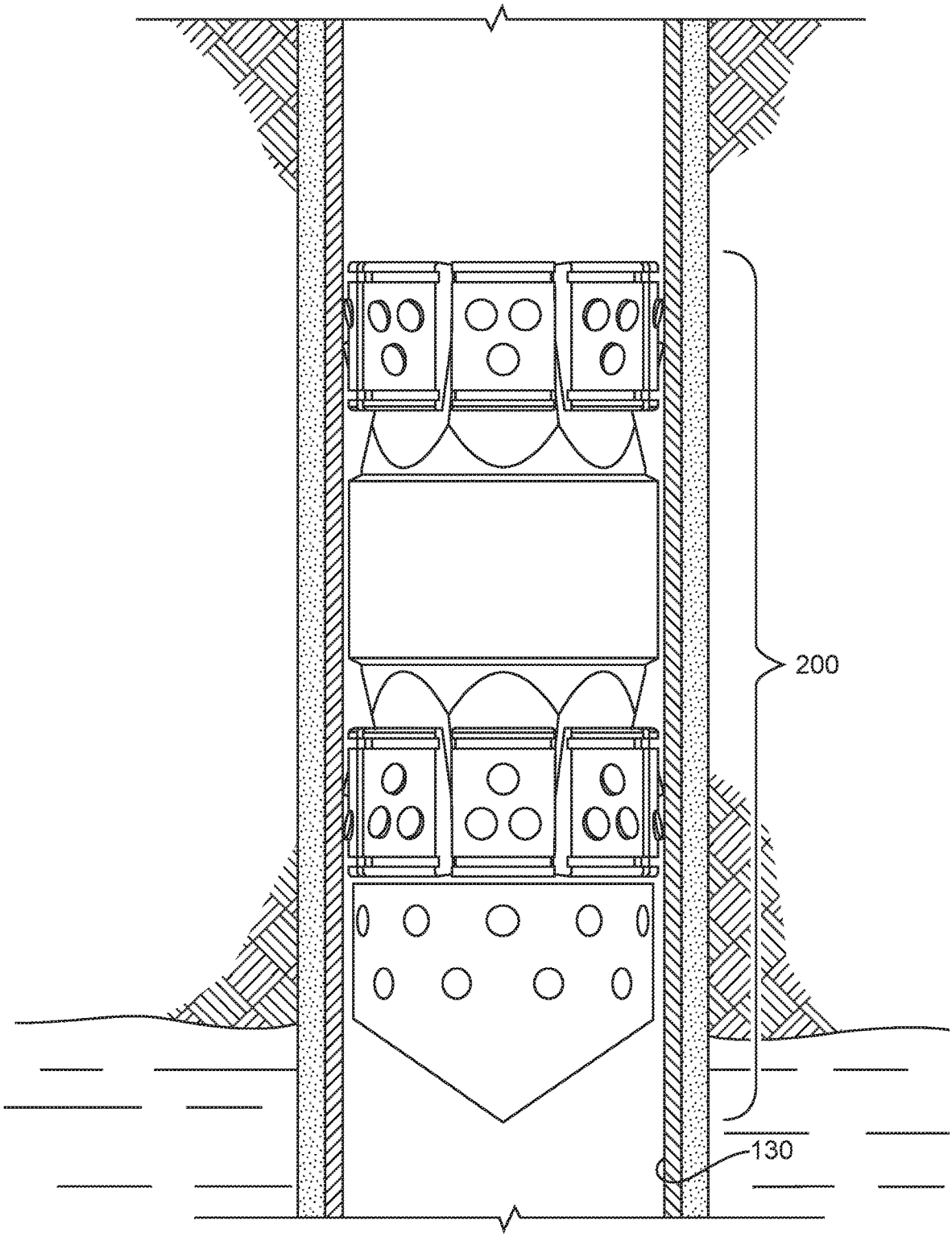
FIG. 3 is a diagram illustrating an exemplary environment for a wellbore isolation assembly in an engaged configuration disposed within a wellbore.

FIG. 2 depicts an exemplary wellbore isolation assembly 200 in a resting configuration disposed within a wellbore 120. In the resting configuration, the wellbore isolation assembly 200 is coupled to a setting tool assembly 300 and conveyance 140. The wellbore isolation assembly 200 is configured such that the wellbore isolation assembly 200 can be moved uphole or downhole without catching on the casing 130 of the wellbore 120. FIG. 3 illustrates the wellbore isolation assembly 200 of FIG. 2 in an engaged configuration, showing the wellbore isolation assembly 200 secured in place within the wellbore 120. In the engaged configuration, protrusions on the wellbore isolation assembly 200 grip onto the casing 130 lining the wellbore 120, such that the wellbore isolation assembly 200 is secured into place. Although FIGS. 2-3 show the wellbore isolation assembly 200 set within a casing 130, it is understood that the device can be set in any type of tubing.

Figure 4:
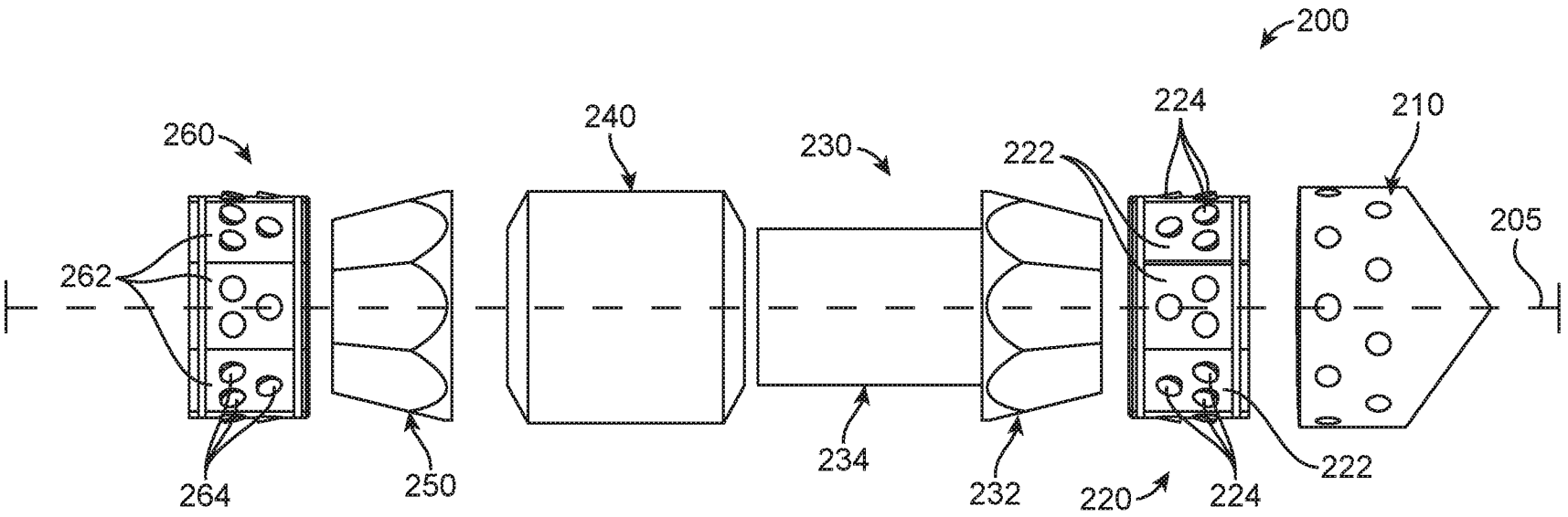
FIG. 4 is an exploded diagram of the wellbore isolation assembly according to the present disclosure.
Figure 5:
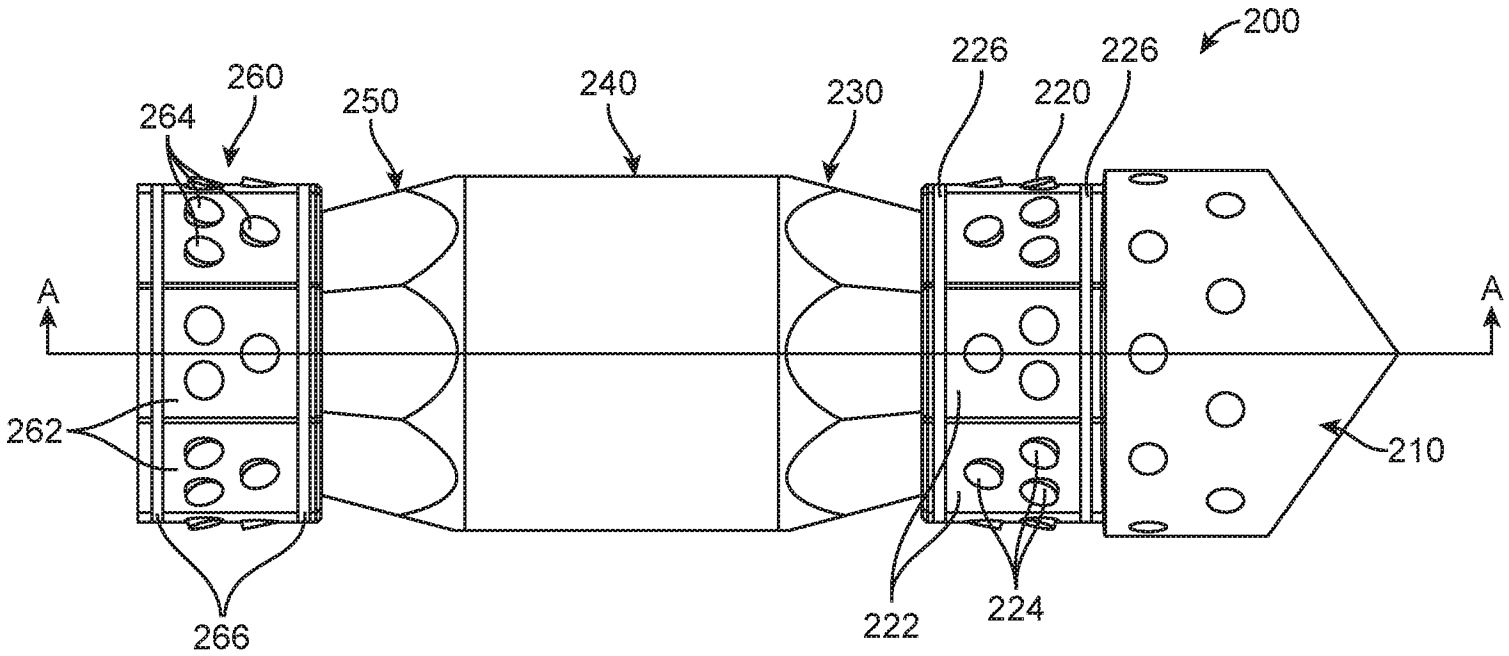
FIG. 5 is an assembled diagram of the wellbore isolation assembly in a resting configuration according to the disclosure herein.

FIG. 4 illustrates an exploded view of a wellbore isolation assembly 200 that can be used in the exemplary wellbore system 100 of FIG. 1. The wellbore isolation assembly 200 is made up of a plurality of independent discrete components unconnected and unsupported by an internal mandrel. As such, an internal mandrel which is a part of conventional packers may be entirely omitted in wellbore isolation assembly 200. The independent discrete components of the wellbore isolation assembly 200 may include an abutment shoe 210, a fixing element including a lower slip 220 and an upper slip 260, a downhole wedge component 230, a sealing element, for example, a seal 240, and an uphole wedge component 240. Each of the plurality of discrete components of the wellbore isolation assembly 200 has a center bore, and the components can be aligned to collectively form a common bore 205 having a central axis A-A (as shown in FIG. 5). The common bore 205 can allow fluid to pass through the wellbore isolation assembly 200.

The downhole wedge component 230 can have a first portion having a ramped external surface 232 and a second portion comprising a tubular member 234 extending from the ramped surface 232. While FIG. 4 generally depicts the tubular member 234 extending from the downhole wedge component 230, it should be understood that the tubular member could also extend from the upper wedge component 250 without departing from the disclosure herein. The seal 240 is sized such that the tubular member 234 can be inserted within the seal 240 whereby the seal 240 is disposed about the tubular member 234 of the downhole wedge component 230. In the alternative, it should be understood that the tubular member could also be integrally formed within the seal itself. The tubular member 234, while having a bore therethrough, is not an internal mandrel as it does not extend to connect and support all the components of the wellbore isolation assembly 200 and further, it is not integrally formed with more than one of any of the components. The tubular member is positioned such that it acts as the internal sealing surface for the sealing element.

The wellbore isolation assembly 200 can be shipped to a desired location unassembled, and when ready for use on-site, the discrete components can be assembled by loading each of them in sequential order onto the setting device 320. Alternatively, the wellbore isolation assembly 200 can be assembled on the setting device 320 prior to shipping and can be held together using shrink wrap, bands, a mild adhesive, or any other means suitable for releasably coupling the discrete components together for transportation.

One or more of the discrete components of the wellbore isolation assembly 200 can be made partially or fully from a downhole degradable metal, including, but not limited to, the downhole abutment shoe 210, the fixing element, the downhole wedge component 230, the sealing element, the uphole wedge component 250, or any other wellbore isolation assembly component thereof. The downhole degradable metal, described herein, can be, but is not limited to, a magnesium alloy and an aluminum alloy. The degradation rate of the downhole degradable metal can be anywhere from about 4 hours to about 120 days from first contact with the appropriate wellbore environment. In some instances, the degradation rate of the downhole degradable metal can be accelerated based on the conditions of the wellbore (either natural or introduced), including temperature, pH, and the like.

In some cases, the seal 240 can include a radially extendible elastomeric sealing surface disposed on the seal. In some cases, the radially extendible elastomeric sealing surface can be comprised of a material capable of degrading when exposed to a wellbore environment. For example, the extendible elastomeric sealing surface can be at least partially composed of an aqueous-degradable elastomer that degrades, at least in part, in the presence of an aqueous fluid, such as preexisting aqueous fluids or introduced aqueous fluids in the wellbore environment. Additionally, the elastomeric sealing surface may degrade, for example, by swelling, dissolving, undergoing a chemical change, undergoing thermal degradation in combination with any of the foregoing, and any combination thereof. Thermal degradation may work in concert with one or more of the other degradation methods that occurs when the elastomeric sealing surface encounters an aqueous fluid. While only seal 240 is shown, one of skill in the art would readily recognize that any sufficient sealing element can be used without departing from the disclosure.

The upper slip 220 and lower slip 260 may have a plurality of individual slips encircled to fit about the ramped external surfaces of the uphole wedge component 250 and the downhole wedge component 230, respectively. The upper slip 260 and lower slip 220 are each configured such that when a force is applied to the inner surface the slips will become radially displaced with respect to the central axis of the wellbore isolation assembly 200. The external surface 222 of lower slip 220 can have one or more gripping protrusions 224 capable of biting into the casing 130 of the wellbore 120. The plurality of encircled individual slips that make up the upper slip 260 can be held together with one or more bands 226. The bands 226 can be any material that breaks or deforms after a predetermined pressure is exceeded. Similarly, the external surface 262 of the upper slip 260 can have one or more gripping protrusions 264 capable of biting into the casing 130 of the wellbore 120 and one or more bands 266. While the only fixing element shown in the figures includes a pair of uni-directional slips opposite each other, one of skill in the art would readily recognize that any suitable means for fixing the wellbore isolation assembly to a casing within a wellbore could be used without departing from the disclosure herein. An assembled view of the wellbore isolation assembly 200 is shown in FIG. 5, showing the central axis A-A of the common bore 205 formed by the aligned discrete components.

Figure 6:
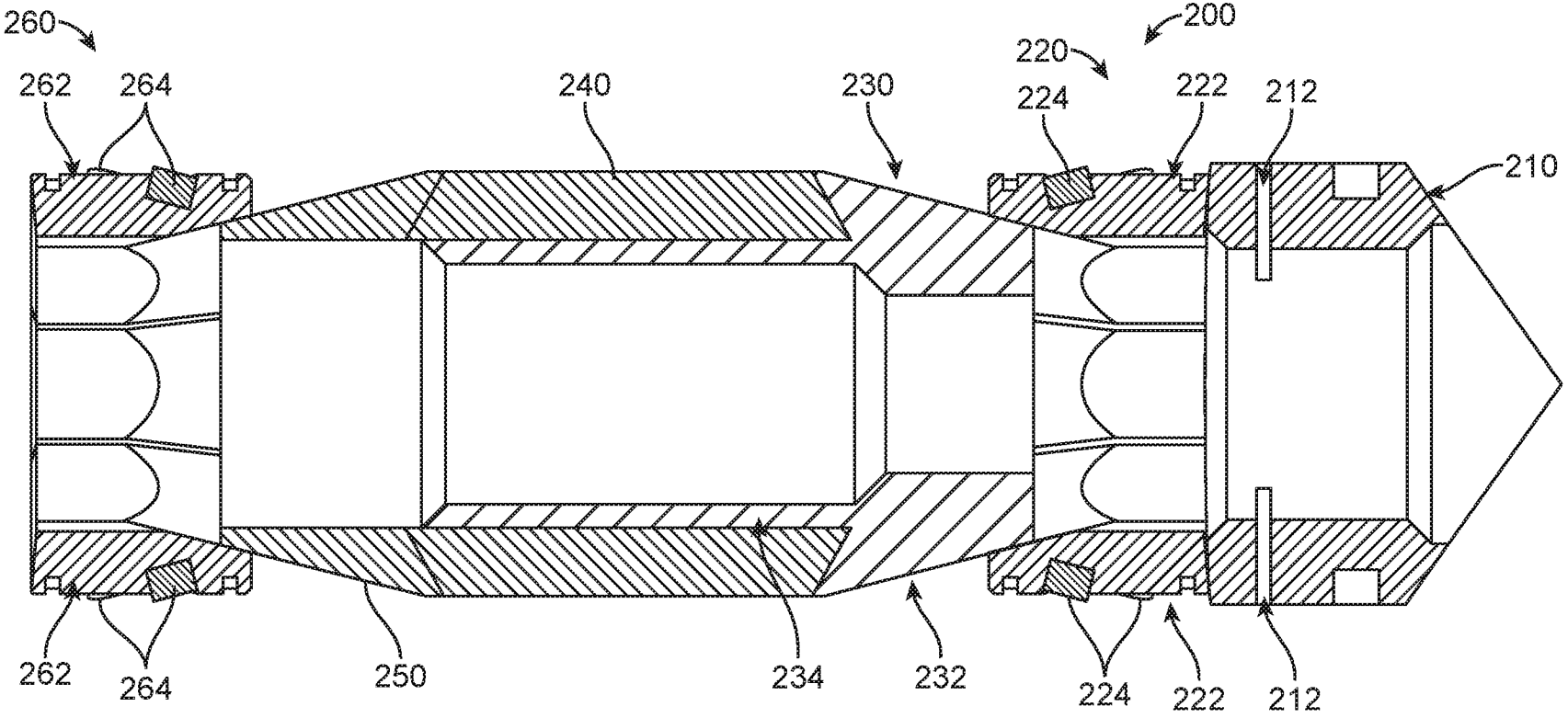
FIG. 6 is a cross sectional diagram of the wellbore isolation assembly in a resting configuration taken along line A-A of FIG. 5.

A cross sectional view of the wellbore isolation assembly 200 is provided in FIG. 6 showing the common bore 205 formed by the discrete components. As shown, the lower slip 220 has a tapered surface on internal surface of the slip. The surface is tapered such that the tapered surface is complementary to the ramped surface of the downhole wedge component 230, allowing the lower slip 220 to be radially displaced when tension is applied to the wellbore isolation assembly 200. While the surface is generally referred to as "tapered", one of skill in the art would understand the surface could be arranged in any one of several manners including, but not limited to, beveled, chamfered, and sloped. Similarly, the internal surface of the upper slip 260 is also a tapered surface complementary to the ramped external surface of the uphole wedge component 250. Additionally, FIG. 6 shows two shearing apertures 212 for receiving shearing pins. While FIGS. 7-9 show two shearing apertures 212, it is understood that any number of shearing aperture can be used.

Figure 7:
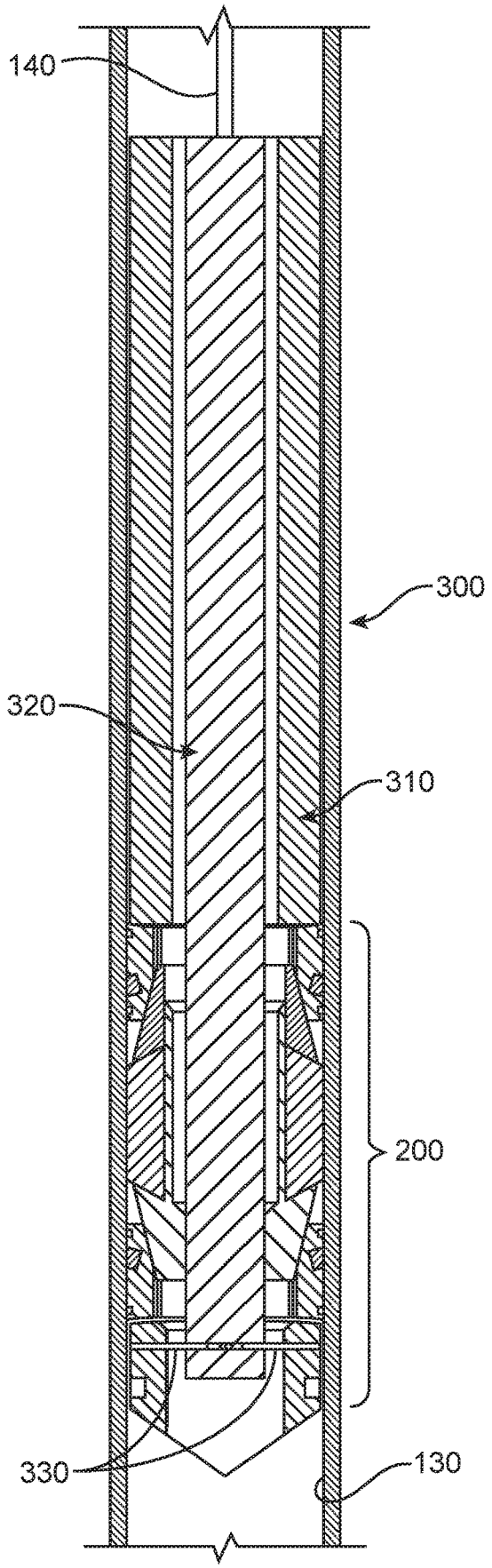
FIG. 7 is a cross sectional diagram of the wellbore isolation assembly as it is being set within a wellbore.

FIG. 7 illustrates a cross sectional view of the wellbore isolation assembly 200 with a setting tool assembly 300 disposed within the common bore of the wellbore isolation assembly 200 while the wellbore isolation assembly 200 is in transition from the resting configuration to the engaged configuration. As shown, the setting tool assembly 300 includes a setting device 320 near the lower end and an abutment shoulder 310. The setting device 320 is secured to the abutment shoe 210 via shear pins 330 held into place by the shearing apertures 212. While only two shear pins 330 are shown, it is understood that any number of shear pins can be used without departing from the disclosure herein. Each of the plurality of discrete components of the wellbore isolation assembly 200 can be placed on top of the abutment shoe 210. An abutment shoulder 310 of the setting tool assembly 300 can be placed against the top of the discrete components of the wellbore isolation assembly 200. The setting tool assembly 300 is actuated by immobilizing the abutment shoulder 310 as the setting device 320 is pulled uphole. As the setting device 320 moves upward, the compressive tension throughout the wellbore isolation assembly 200 increases. The upper slip 260 radially expands breaking the bands 266 and the slip 260 slides onto the external surface of the upper wedge component 250, as the upper slip 260 expands the protrusions 264 on the external surface 262 grip into the casing 130 of the wellbore 120. Similarly, the bands 226 of the lower slip 220 break apart and the lower slip 220 slides onto the downhole wedge component 230. As the wellbore isolation assembly 200 compresses, the seal 240 radially expands and creates a tight seal against the casing 130 of the wellbore 120. When the wellbore isolation assembly 200 is secured in place, the shearing pins 320 shear and the setting device 320 and abutment shoulder 310 are retracted from the wellbore 120 and can be used again. While FIG. 7 shows the setting assembly 300 coupled to the wellbore isolation assembly 200 via shearing pins, it should be understood that any other suitable coupling means may be used.

The setting tool 300 disclosed herein can be any type of setting device, including, but not limited to commercially available tools such as the baker 10 or baker 20 E-4™ setting devices.

Figure 8:
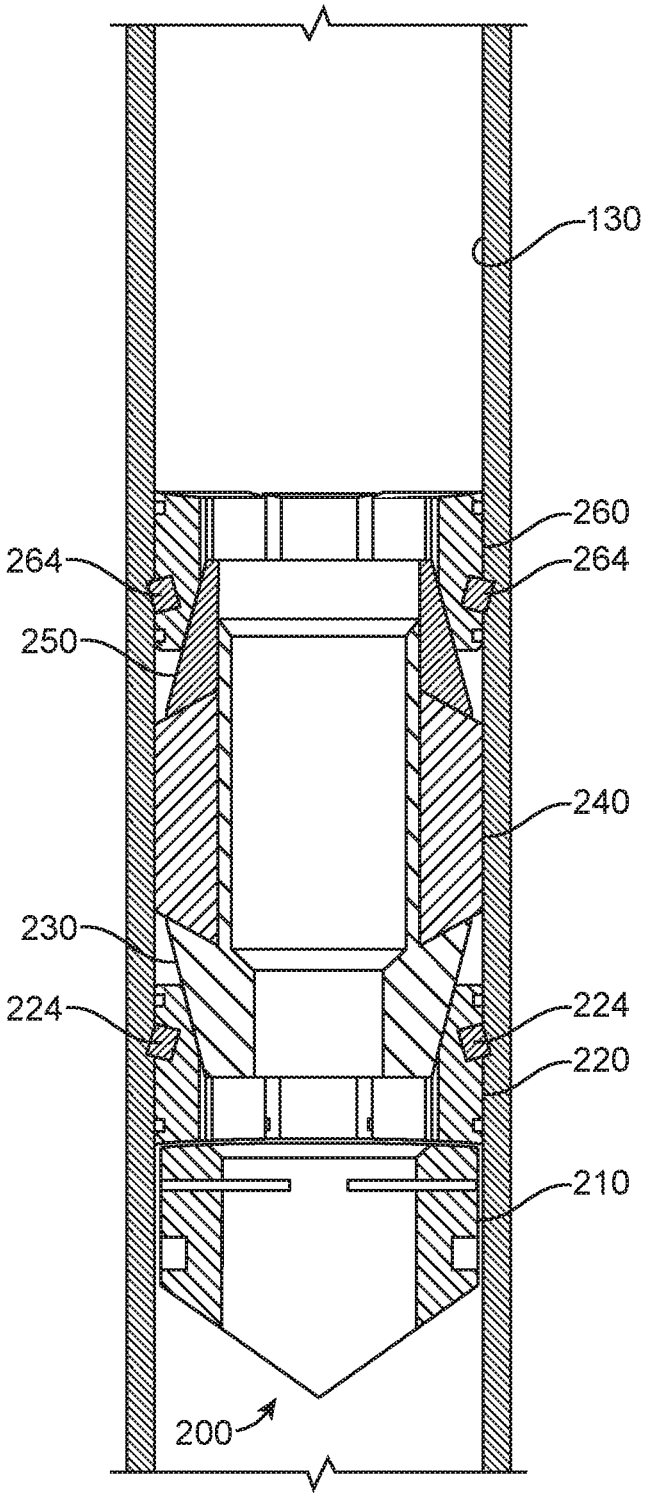
FIG. 8 is a cross sectional diagram of the wellbore isolation assembly in an engaged configuration within a wellbore.
Figure 9:
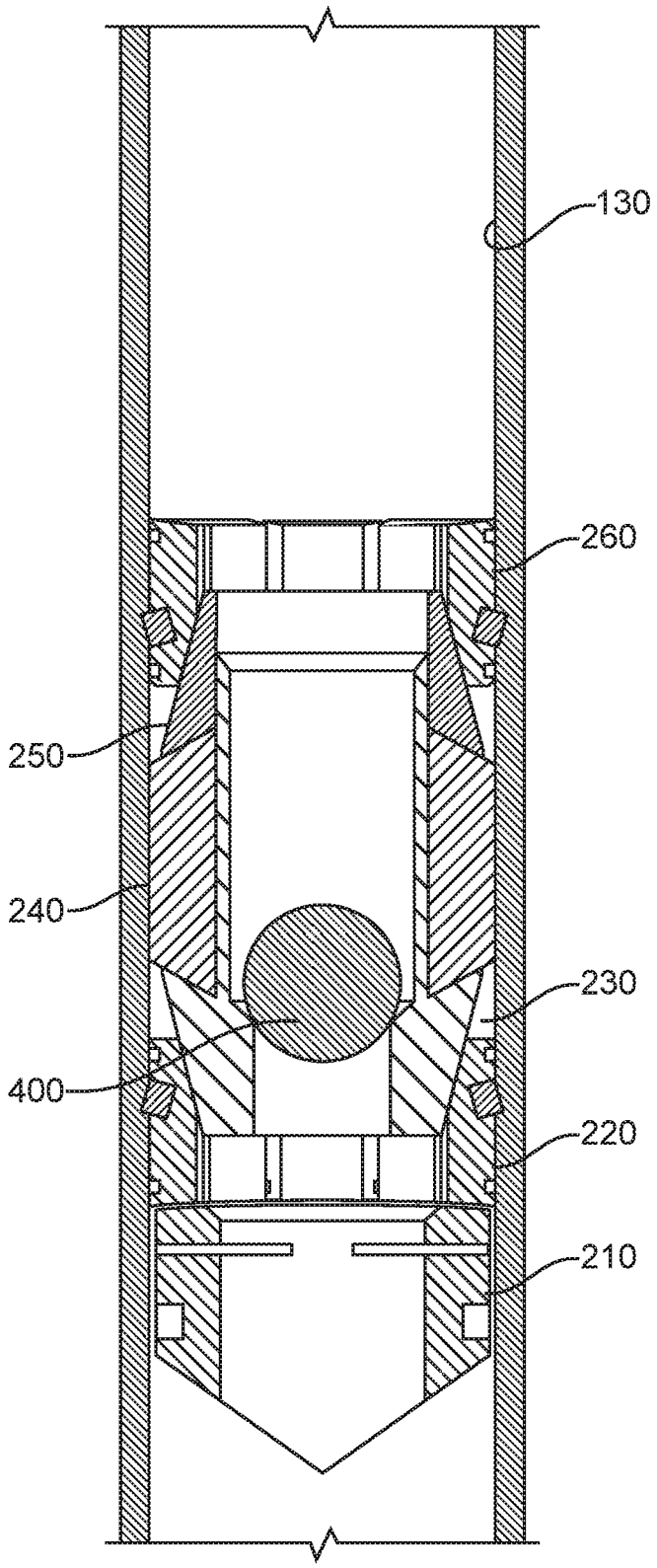
FIG. 9 is a cross sectional diagram of a wellbore isolation assembly when a ball is seated.

FIG. 8 illustrates a cross sectional view of the engaged configuration of the wellbore isolation assembly 200 partially surrounded by the casing 130 of a wellbore 120. As shown in FIG. 8, the protrusions 224, 264 of the upper and lower slips 260, 220 grip into the casing 130 of the wellbore 120 and the seal 240 is expanded to hold the upper and lower slips 260, 220 in tension. The common bore 205 can be plugged with a ball 400 seated within the tubular member 234 of the wellbore isolation assembly 200, as shown in FIG. 9. The ball 400 can seal the common bore 205 such that only single-directional flow is permitted, allowing for fracing within the wellbore 120.

Figure 10:
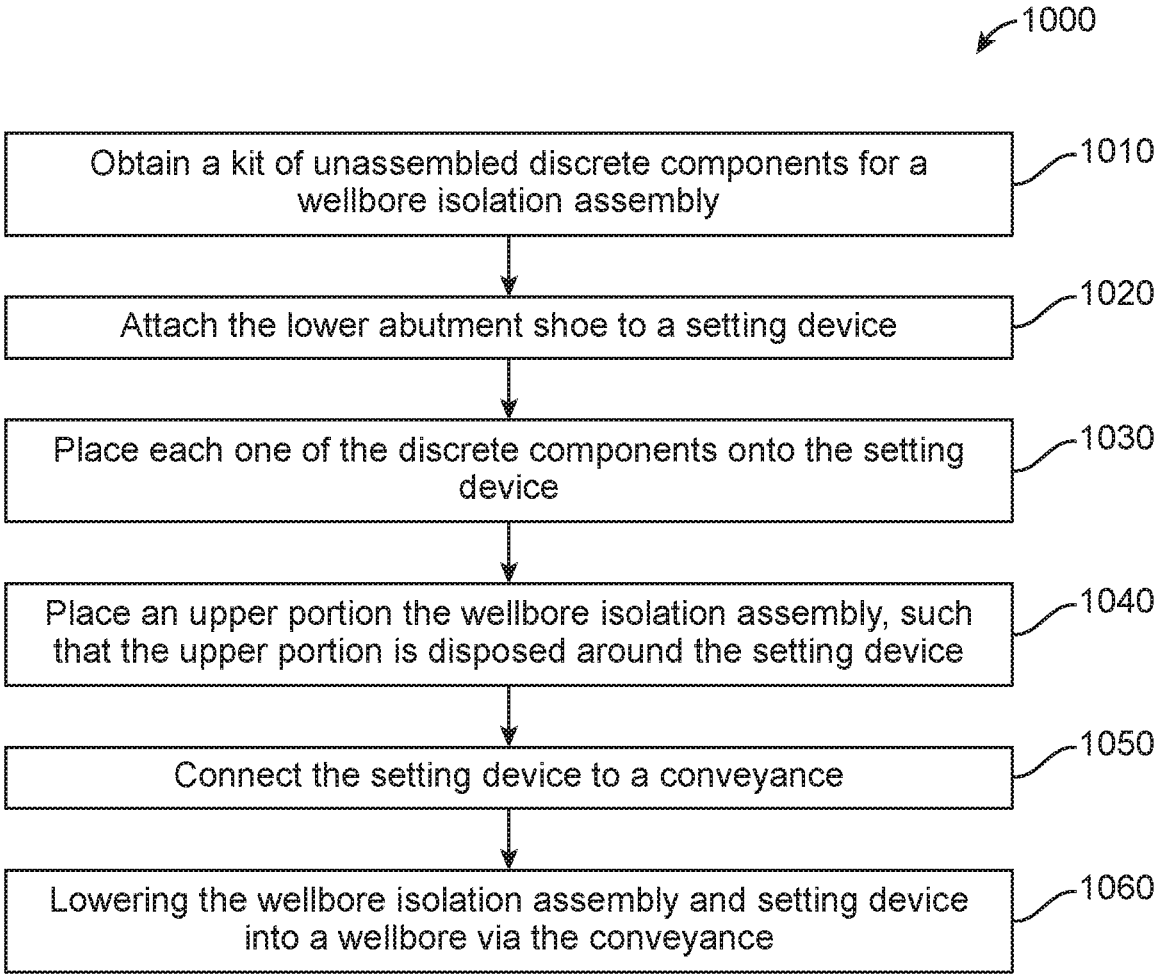
FIG. 10 is a flowchart showing a method of assembling a wellbore isolation assembly.

The method for assembling a wellbore isolation assembly on a setting device can follow the flow diagram 1000 depicted in FIG. 10. For example, beginning at block 1010, a kit of unassembled discrete components can be obtained. In block 1020, one of the discrete components, for example an abutment shoe, can be attached to a setting device. As discussed above, while FIG. 7 generally depicts the abutment shoe attached to the setting device via shearing pins, any suitable coupling means can be used. In block 1030, each of the remaining discrete components can be placed on to the setting device such that they rest on the abutment shoe and are disposed around the setting device. While FIG. 10 generally describes a method for assembling a wellbore isolation assembly beginning with the abutment shoe, those of skill in the art would readily recognize the wellbore isolation device could also be assembled beginning with the upper slip and continuing through the discrete components in the opposite order. In block 1040, an abutment shoulder can be placed on the setting device above the top-most discrete component of the wellbore isolation assembly, such that the wellbore isolation assembly is secured onto the setting device.

At block 1050, the setting device can be connected to a conveyance. As described above, any type of suitable conveyance can be used. In block 1060, the wellbore isolation assembly, setting device, and abutment shoulder are lowered into a wellbore via the conveyance. Once the wellbore isolation assembly reaches a desired location, the setting device can be actuated to secure the wellbore isolation assembly in place and the setting device and abutment shoulder can be retracted and used again.

Numerous examples are provided herein to enhance understanding of the present disclosure. A specific set of statements are provided as follows.

Statement 1: A wellbore isolation assembly comprising a plurality of discrete components each having an inner bore with a center axis, the plurality of discrete components axially abuttable such that each of the inner bores align to form a common bore, the plurality of discrete components comprising a fixing element; and a sealing element; wherein the plurality of discrete components are integrable by a setting device receivable through the common bore, and wherein application of a compressive force to the plurality of discrete components urges the fixing element and the sealing element to radially extend, relative to the axis of the common bore.

Statement 2: A wellbore isolation assembly according to Statement 1, wherein the fixing element comprises an upper slip and a lower slip.

Statement 3: A wellbore isolation assembly according to Statement 1 or Statement 2, wherein the plurality of discrete components further comprises an abutment shoe and at least one wedge component.

Statement 4: A wellbore isolation assembly according to Statements 1-3, wherein the upper slip has a downhole end having a tapered inner surface engagable with at least a portion of a ramped external surface of an uphole wedge component, thereby forming at least a portion of the common bore; the lower slip has an uphole end having a chamfered inner surface engagable with at least a portion of a ramped external surface of a downhole wedge component, thereby forming at least a portion of the common bore; the sealing element is disposed between the upper wedge component and the lower wedge component; and the abutment shoe abutting a downhole end of the downhole wedge component.

Statement 5: A wellbore isolation assembly according to Statements 1-4, wherein responsive to the compressive force the plurality of discrete components is urged together, engaging the fixing element with an internal surface of a wellbore when inserted therein.

Statement 6: A wellbore isolation assembly according to Statements 1-5, wherein the plurality of discrete components are arrangeable sequentially on the setting device.

Statement 7: A wellbore isolation assembly according to Statements 1-6, further comprising a tubular member having an inner tubular bore, wherein the tubular member is integrally formed with one of the plurality of discrete components and provides an internal sealing surface for the common bore.

Statement 8: A wellbore isolation assembly according to Statements 1-7, wherein the plurality of discrete components are contained unassembled in a package.

Statement 9: A wellbore isolation assembly according to Statements 1-8, wherein at least one of the plurality of discrete components comprises a downhole degradable metal.

Statement 10: A wellbore isolation assembly according to Statements 1-9, wherein the downhole degradable metal is selected from the group consisting of a magnesium alloy, an aluminum alloy, and a combination thereof.

Statement 11: A wellbore isolation assembly according to Statements 1-10, wherein each of the discrete components are held abutted together via an adhesive, a shrinkwrap, a pressure fit, or any other suitable means of joinder.

Statement 12: A wellbore isolation assembly according to Statements 1-11, wherein the plurality of discrete components is contained assembled in a package.

Statement 13: A method of assembling a wellbore isolation device comprising placing a plurality of discrete components onto a setting device in sequential order, the plurality of discrete components comprising a fixing element; and a sealing element, wherein the plurality of discrete components are integrable by the setting device.

Statement 14: A method according to Statement 13, wherein the plurality of discrete components each have inner bores with a center axis, the plurality of discrete components aligning to form a common bore which receives the setting device.

Statement 15: A method according to Statement 13 or Statement 14, wherein the fixing element comprises an upper slip and a lower slip.

Statement 16: A method according to Statements 13-15, wherein the plurality of discrete components further comprises an abutment shoe and at least one wedge component.

Statement 17: A method according to Statements 13-16, wherein the upper slip has a downhole end having a tapered inner surface engagable with at least a portion of a ramped external surface of an uphole wedge component, thereby forming at least a portion of the common bore; the lower slip has an uphole end having a tapered inner surface engagable with at least a portion of a ramped external surface of a downhole wedge component, thereby forming at least a portion of the common bore; the sealing element is disposed between the uphole wedge component and the downhole wedge component; and the abutment shoe abutting a downhole end of the downhole wedge component.

Statement 18: A method according to Statements 13-17, wherein the wellbore isolation assembly further comprises a tubular member having an inner tubular bore, wherein the tubular member is integrally formed with one of the plurality of discrete components and provides an internal sealing surface for the common bore.

Statement 19: A method according to Statements 13-18, further comprising bonding the plurality of discrete components together via an adhesive, a shrinkwrap, a pressure fit, or any other suitable means of joinder.

Statement 20: A method according to Statements 13-19, wherein the plurality of discrete components is received assembled in a package.

Statement 21: A method according to Statements 13-20, further comprising arranging the wellbore isolation assembly directly on the setting device.

Statement 22: A method according to Statements 13-21, wherein the plurality of discrete components is received unassembled in a package.

Statement 23: A method according to Statements 13-22, wherein at least one of the plurality of discrete components comprises a downhole degradable metal.

Statement 24: A method according to Statements 13-23, wherein the downhole degradable metal is selected from the group consisting of a magnesium alloy, an aluminum alloy, and a combination thereof.

Statement 25: A wellbore isolation system comprising a plurality of discrete components each having an inner bore with a center axis, the plurality of discrete components axially abuttable such that each of the inner bores align to form a common bore, the plurality of discrete components comprising a fixing element; and a sealing element; wherein the plurality of discrete components are integrable by a setting device receivable through the common bore, and wherein application of a compressive force to the plurality of discrete components urges the fixing element and the sealing element to radially extend, relative to the axis of the common bore.

Statement 26: A wellbore isolation system according to Statement 25, wherein the plurality of discrete components are placed on the setting device and provided in a wellbore.

Statement 27: A wellbore isolation system according to Statement 25 or Statement 26, wherein the fixing element comprises an upper slip and a lower slip.

Statement 28: A wellbore isolation system according to Statements 25-27, wherein the plurality of discrete components further comprises an abutment shoe and at least one wedge component.

Statement 29: A wellbore isolation system according to Statements 25-28, wherein the upper slip has a downhole end having a tapered inner surface engagable with at least a portion of a ramped external surface of an uphole wedge component, thereby forming at least a portion of the common bore; the lower slip has an uphole end having a tapered inner surface engagable with at least a portion of a ramped external surface of a downhole wedge component, thereby forming at least a portion of the common bore; the sealing element is disposed between the uphole wedge component and the downhole wedge component; and the abutment shoe abutting the downhole end of the downhole wedge component.

Statement 30: A wellbore isolation system according to Statements 25-29, further comprising a tubular member having an inner tubular bore, wherein the tubular member is integrally formed with one of the plurality of discrete components and provides an internal sealing surface for the common bore.

Statement 31: A wellbore isolation system according to Statements 25-30, wherein responsive to the compressive force the plurality of discrete components are urged together, engaging the fixing element with an internal surface of a wellbore when inserted therein.

Statement 32: A wellbore isolation system according to Statements 25-31, wherein the plurality of discrete components are arranged sequentially on the setting device.

Statement 33: A wellbore isolation system according to Statements 25-32, wherein the plurality of discrete components are contained unassembled in a package.

Statement 34: A wellbore isolation system according to Statements 25-33, wherein at least one of the plurality of discrete components comprises a downhole degradable metal.

Statement 35: A wellbore isolation system according to Statements 25-34, wherein the downhole degradable metal is selected from the group consisting of a magnesium alloy, an aluminum alloy, and a combination thereof.

Statement 36: A wellbore isolation system according to Statements 25-35, further comprising bonding the plurality of discrete components together via an adhesive, a shrink-wrap, a pressure fit, or any other suitable means of joinder.

Statement 37: A wellbore isolation system according to Statements 25-36, wherein the plurality of discrete components is contained assembled in a package.

Statement 38: A wellbore isolation assembly comprising an upper slip having an external surface and a first inner bore formed therein; an uphole wedge component having a ramped external surface receivable in the first inner bore; a downhole wedge component having a ramped external surface; a seal having a second inner bore and a radially extendible elastomeric sealing surface, the seal positionable between the uphole wedge component and downhole wedge component; a lower slip having an external surface and a third inner bore formed therein, the ramped surface of the downhole wedge component receivable in the third inner bore; and an abutment shoe for abutting against the downhole wedge; wherein each of the upper slip, uphole wedge, downhole wedge, seal, lower slip and lower abutment are each discrete components which form a common bore when aligned for receiving a setting device and wherein each of the upper slip, the uphole wedge component, the downhole wedge component, the seal, the lower slip, and the abutment shoe are connected without an intervening mandrel.

Statement 39: A wellbore isolation assembly according to Statement 38, wherein application of a compressive tension to the assembly, the uphole wedge is urged into the first inner bore of the upper slip, the downhole wedge is urged into the lower slip, and the seal is compressed between the uphole wedge component and the downhole wedge component, and the abutment shoe is urged against the downhole wedge component, whereby the upper slip, the lower slip, and the seal radially extend responsive to the applied tension.

Statement 40: A wellbore isolation assembly according to Statement 38 or Statement 39, further comprising a tubular member having an inner tubular bore, the tubular member integrally formed with one of the uphole wedge component or the downhole wedge component and insertable into the second inner bore.

Statement 41: A method of assembling a wellbore isolation device comprising placing components of a wellbore isolation assembly on a setting device, the components of the wellbore isolation assembly comprising an upper slip having an external surface and a first inner bore formed therein; an uphole wedge component having a ramped external surface receivable in the first inner bore; a downhole wedge component having a ramped external surface; a seal having a second inner bore and a radially extendible elastomeric sealing surface, the seal positioned between the uphole wedge component and downhole wedge component; a lower slip having an external surface and a third inner bore formed therein, the ramped surface of the downhole wedge component receivable in the third inner bore; an abutment shoe for abutting against the downhole wedge, wherein each of the upper slip, the uphole wedge component, the downhole wedge component, the seal, the lower slip, and the lower abutment are connected without an intervening mandrel, wherein the abutment shoe is placed on an end of the setting device, and wherein each of the upper slip, the uphole wedge component, the seal, the downhole wedge component, the lower slip, and the lower abutment form a common bore which receives the setting device when placed thereon.

Statement 42: A method according to Statement 41, wherein the wellbore isolation assembly further comprises a tubular member having an inner tubular bore, the tubular member integrally formed with one of the uphole wedge component or the downhole wedge component and insertable into the second inner bore.

Statement 43: A system comprising a wellbore isolation assembly placed on a setting device and disposed in a wellbore, and the wellbore isolation device comprising an upper slip having an external surface and a first inner bore formed therein; an uphole wedge component having a ramped external surface receivable in the first inner bore; a downhole wedge component having a ramped external surface; a seal having a second inner bore and a radially extendible elastomeric sealing surface, the seal positionable between the uphole wedge component and downhole wedge component; a lower slip having an external surface and a third inner bore formed therein, the ramped surface of the downhole wedge component receivable in the third inner bore; an abutment shoe for abutting against the downhole wedge; wherein application of a compressive tension to the assembly, the uphole wedge is urged into the first inner bore of the upper slip, the downhole wedge is urged into the lower slip, and the seal is compressed between the uphole wedge component and downhole wedge component, and the abutment shoe is urged against the downhole wedge, whereby the upper slip, the lower slip, and the seal radially extend responsive to the applied tension, and wherein each of the upper slip, the uphole wedge component, the downhole wedge component, the seal, the lower slip, and the lower abutment are each discrete components which form a common bore when aligned for receiving a setting device.

Statement 44: A system according to Statement 43, further comprising a tubular member having an inner tubular bore, the tubular member integrally formed with one of the uphole wedge component or the downhole wedge component and insertable into the second inner bore.

Statement 45: A method comprising running a wellbore isolation assembly and a setting device into a wellbore to a predetermined depth, wherein the wellbore isolation assembly comprises an upper slip having an external surface and a first inner bore formed therein; an uphole wedge component having a ramped external surface receivable in the first inner bore; a downhole wedge component having a ramped external surface; a seal having a second inner bore and a radially extendible elastomeric sealing surface, the seal positionable between the uphole wedge component and downhole wedge component; a lower slip having an external surface and a third inner bore formed therein, the ramped surface of the downhole wedge component receivable in the third inner bore; an abutment shoe for abutting against the downhole wedge; whereby the upper slip, the lower slip, and the seal radially extend responsive to an applied tension, and wherein each of the upper slip, the uphole wedge component, the downhole wedge component, the seal, the lower slip, and the lower abutment are each discrete components which form a common bore when aligned for receiving the setting device, and actuating the setting device to apply a compressive tension to the assembly such that the uphole wedge component is urged into the first inner bore of the upper slip, the downhole wedge component is urged into the lower slip, and the seal is compressed between the uphole wedge component and the downhole wedge component, and the abutment shoe is urged against the downhole wedge component.

Statement 46: A method according to Statement 46, further comprising a tubular member having an inner tubular bore, the tubular member integrally formed with one of the uphole wedge component or the downhole wedge component and insertable into the second inner bore.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A wellbore isolation assembly comprising:

a plurality of discrete components each having an inner bore with a center axis, the plurality of discrete components axially abuttable such that each of the inner bores aligns to form a common bore, the plurality of discrete components comprising:

an upper slip;

a lower slip;

an uphole wedge component having a ramped external surface for engaging the upper slip;

a downhole wedge component having a ramped external surface for engaging the lower slip;

a sealing element, the sealing element disposed between the upper wedge component and the lower wedge component, the downhole wedge component having a first portion with the ramped external surface and having a second portion with a tubular member extending from the first portion over which the sealing element fits, the sealing element abutting both the upper wedge component and lower wedge component; and an abutment shoe, wherein the plurality of discrete components are integrable by a setting device receivable through the common bore, and wherein application of the compressive force to the plurality of discrete components urges the plurality of discrete components together, such that the sealing element is urged over the tubular member, the sealing element abuts the upper wedge component and the lower wedge component such that the sealing element is compressed and expands radially relative to the axis of the common bore, the upper slip and the lower slip are caused to become radially displaced, the lower slip being urged radially outward by the ramped surface of the downhole wedge component and the upper slip being urged radially outward by the ramped surface of the uphole wedge component.

2. The wellbore isolation assembly of claim 1, wherein the upper slip has a downhole end having a tapered inner surface engagable with at least a portion of the ramped external surface of the uphole wedge component, thereby forming at least a portion of the common bore;

the lower slip has an uphole end having a tapered inner surface engagable with the ramped external surface of the downhole wedge component, thereby forming at least a portion of the common bore;

and the abutment shoe abutting a downhole end of the downhole wedge component.

3. The wellbore isolation assembly of claim 1, wherein responsive to the compressive force the plurality of discrete components are urged together, engaging the fixing element with an internal surface of a wellbore when inserted therein.

4. The wellbore isolation assembly of claim 1, wherein the plurality of discrete components are arrangeable sequentially on the setting device.

5. The wellbore isolation assembly of claim 1, further comprising a tubular member having an inner tubular bore, wherein the tubular member is integrally formed with one of the plurality of discrete components and provides an internal sealing surface for the common bore.

6. The wellbore isolation assembly of claim 1, wherein the tubular member has a constant outer diameter.

7. A method of assembling a wellbore isolation device comprising:

placing a plurality of discrete components onto a setting device in sequential order, the plurality of discrete components comprising:

an upper slip;

a lower slip;

an uphole wedge component having a ramped external surface for engaging the upper slip;

a downhole wedge component having a ramped external surface for engaging the lower slip;

a sealing element, the sealing element disposed between the upper wedge component and the lower wedge component, the downhole wedge component having a first portion with the ramped external surface and having a second portion with a tubular member extending from the first portion over which the sealing element fits, the sealing element abutting both the upper wedge component and lower wedge component; and an abutment shoe, wherein the plurality of discrete components are integrable by the setting device, and wherein application of the compressive force to the plurality of discrete components urges the plurality of discrete components together, such that the sealing element is urged over the tubular member, the sealing element abuts the upper wedge component and the lower wedge component such that the sealing element expands radially relative to the axis of the common bore, the upper slip and the lower slip are caused to become radially displaced, the lower slip being urged radially outward by the ramped surface of the downhole wedge component and the upper slip being urged radially outward by the ramped surface of the uphole wedge component.

8. The method of claim 7, wherein the plurality of discrete components each have inner bores with a center axis, the plurality of discrete components aligning to form a common bore which receives the setting device.

9. The method of claim 7, wherein the upper slip has a downhole end having a tapered inner surface engagable with at least a portion of the ramped external surface of the uphole wedge component, thereby forming at least a portion of the common bore;

the lower slip has an uphole end having a tapered inner surface engagable with the ramped external surface of the downhole wedge component, thereby forming at least a portion of the common bore;

and the abutment shoe abutting a downhole end of the downhole wedge component.

10. The method of claim 7, wherein the tubular member is integrally formed with one of the plurality of discrete components and provides an internal sealing surface for the common bore.

11. The method of claim 7, further comprising bonding the plurality of discrete components together.

12. A wellbore isolation system comprising:

a plurality of discrete components each having an inner bore with a center axis, the plurality of discrete components axially abuttable such that each of the inner bores align to form a common bore, the plurality of discrete components comprising:

an upper slip;

a lower slip;

an uphole wedge component having a ramped external surface for engaging the upper slip;

a downhole wedge component having a ramped external surface for engaging the lower slip;

a sealing element, the sealing element disposed between the upper wedge component and the lower wedge component, the downhole wedge component having a first portion with the ramped external surface and having a second portion with a tubular member extending from the first portion over which the sealing element fits, the sealing element abutting both the upper wedge component and lower wedge component; and an abutment shoe, wherein the plurality of discrete components are integrable by a setting device receivable through the common bore, and wherein application of the compressive force to the plurality of discrete components urges the plurality of discrete components together, such that the sealing element is urged over the tubular member, the sealing element abuts the upper wedge component and the lower wedge component such that the sealing element expands radially relative to the axis of the common bore, the upper slip and the lower slip are caused to become radially displaced, the lower slip being urged radially outward by the ramped surface of the downhole wedge component and the upper slip being urged radially outward by the ramped surface of the uphole wedge component.

13. The system of claim 12, wherein the plurality of discrete components are placed on the setting device and disposed within a wellbore.

14. The system of claim 12, wherein the upper slip has a downhole end having a tapered inner surface engagable with at least a portion of the ramped external surface of the uphole wedge component, thereby forming at least a portion of the common bore;

the lower slip has an uphole end having a tapered inner surface engagable with the ramped external surface of the downhole wedge component, thereby forming at least a portion of the common bore;

the sealing element is disposed between the uphole wedge component and the downhole wedge component; and the abutment shoe abutting the downhole end of the downhole wedge component.

15. The system of claim 12, further comprising a tubular member having an inner tubular bore, wherein the tubular member is integrally formed with one of the plurality of discrete components and provides an internal sealing surface for the common bore.

* * * * *